US006408464B1

(12) United States Patent
Weismiller et al.

(10) Patent No.: US 6,408,464 B1
(45) Date of Patent: Jun. 25, 2002

(54) BIRTHING BED FOOT SECTION ATTACHMENT MECHANISM

(75) Inventors: Matthew W. Weismiller; Peter M. Wukusick, both of Batesville, IN (US)

(73) Assignee: Hill-Rom Services, Inc., Wilmington, DE (US)

( * ) Notice: Subject to any disclaimer, the term of this patent is extended or adjusted under 35 U.S.C. 154(b) by 0 days.

(21) Appl. No.: 09/379,446

(22) Filed: Aug. 23, 1999

(51) Int. Cl.[7] ..... A61G 7/015
(52) U.S. Cl. ..... 5/602; 5/624
(58) Field of Search ..... 5/602, 620, 621, 5/624; 292/152, 153, 303, 304

(56) References Cited

U.S. PATENT DOCUMENTS

| | | | | |
|---|---|---|---|---|
| 964,170 A | | 7/1910 | Leonard | |
| 2,067,891 A | * | 1/1937 | Comper | 5/602 X |
| 2,120,732 A | * | 6/1938 | Comper et al. | 5/602 |
| 2,257,491 A | * | 9/1941 | Armstrong | 5/602 |
| 2,306,031 A | * | 12/1942 | Anderson et al. | 5/620 X |
| 2,381,633 A | * | 8/1945 | Young | 292/304 |
| 2,658,211 A | | 11/1953 | Bendersky | |
| 2,754,142 A | * | 7/1956 | Baker, Jr. | 292/304 |
| 2,766,463 A | | 10/1956 | Bendersky | |
| 2,832,655 A | * | 4/1958 | Adolphson | 5/620 X |
| 2,872,259 A | * | 2/1959 | Thorpe | 5/621 X |
| 3,100,129 A | | 8/1963 | Adolphson | |
| 3,226,105 A | | 12/1965 | Weickgenannt | |
| 3,227,440 A | | 1/1966 | Scott | |
| 3,318,596 A | | 5/1967 | Herzog | |
| 3,813,091 A | * | 5/1974 | Metzger | 5/624 X |
| 3,817,512 A | | 6/1974 | Torrey | |
| 3,845,945 A | | 11/1974 | Lawley et al. | |
| 3,868,103 A | | 2/1975 | Pageot et al. | |
| 4,225,126 A | | 9/1980 | Lee | |
| 4,323,060 A | | 4/1982 | Pecheux | |
| 4,333,638 A | * | 6/1982 | Gillotti | 5/620 X |
| 4,411,035 A | * | 10/1983 | Fenwick | 5/602 |
| 4,426,071 A | | 1/1984 | Klevstad | |
| 4,552,348 A | | 11/1985 | Forssmann et al. | |

(List continued on next page.)

FOREIGN PATENT DOCUMENTS

| | | |
|---|---|---|
| DE | 2324486 | 12/1973 |
| FR | 1518724 | 12/1966 |
| FR | 2666013 | 2/1992 |
| GB | 2225228 A | 5/1990 |
| JP | 56-109663 | 8/1981 |
| JP | 60-85749 | 5/1985 |
| JP | 60-195018 | 12/1985 |
| JP | 61-22577 | 6/1986 |
| JP | 61-119257 | 6/1986 |
| JP | 61-168351 | 7/1986 |
| JP | 61-44019 | 10/1986 |
| JP | 61-50626 | 11/1986 |
| JP | 2-147120 | 12/1990 |
| JP | 2-297366 | 12/1990 |
| JP | 2-297367 | 12/1990 |
| JP | 2-297368 | 12/1990 |
| JP | 3-4808 | 1/1991 |
| JP | 3-4809 | 1/1991 |
| JP | 5-31145 | 2/1993 |
| JP | 6-12755 | 4/1994 |
| JP | 7-112012 | 5/1995 |

*Primary Examiner*—Robert G. Santos
(74) *Attorney, Agent, or Firm*—Bose McKinney & Evans LLP

(57) ABSTRACT

A birthing bed includes a patient support having a central opening into which a removable foot section is inserted. A foot section attachment mechanism is provided for attaching the foot section to the patient support such that the foot section is not aligned with the patient support until the foot section is fully inserted into the patient support and latched to the patient support, and such that the foot section is aligned with the patient support only when the foot section is fully inserted into the patient support and latched to the patient support.

12 Claims, 7 Drawing Sheets

U.S. PATENT DOCUMENTS

| | | | | | |
|---|---|---|---|---|---|
| 4,564,164 | A | | 1/1986 | Allen et al. | |
| 4,577,730 | A | | 3/1986 | Porter | |
| 4,615,058 | A | * | 10/1986 | Feldt | 5/602 |
| 4,632,349 | A | | 12/1986 | Anstey | |
| 4,682,376 | A | * | 7/1987 | Feldt | 5/602 |
| 4,688,780 | A | * | 8/1987 | Hanz | 5/621 |
| 4,698,837 | A | | 10/1987 | Van Steenburg | |
| 4,724,555 | A | | 2/1988 | Poehner et al. | |
| 4,807,618 | A | | 2/1989 | Auchinleck et al. | |
| 4,886,258 | A | | 12/1989 | Scott | |
| 4,894,876 | A | | 1/1990 | Fenwick | |
| 4,898,491 | A | | 2/1990 | Van Steenburg | |
| 4,940,218 | A | | 7/1990 | Akcelrod | |
| 4,993,762 | A | * | 2/1991 | Rogers et al. | 292/303 |
| 5,039,167 | A | | 8/1991 | Sweet | |
| 5,104,363 | A | | 4/1992 | Shi | |
| 5,116,008 | A | | 5/1992 | Allen | |
| 5,129,117 | A | | 7/1992 | Celestina et al. | |
| 5,134,737 | A | * | 8/1992 | Wyman | 5/620 X |
| 5,148,562 | A | | 9/1992 | Borders et al. | |
| 5,157,800 | A | | 10/1992 | Borders | |
| 5,201,087 | A | | 4/1993 | Wickham et al. | |
| 5,214,812 | A | | 6/1993 | Bartow et al. | |
| 5,226,187 | A | | 7/1993 | Borders et al. | |
| 5,362,302 | A | | 11/1994 | Jensen et al. | |
| 5,472,412 | A | | 12/1995 | Knoth | |
| 5,481,770 | A | | 1/1996 | Ahlsten | |
| 5,560,577 | A | | 10/1996 | Keselman | |
| 5,636,899 | A | | 6/1997 | Schiff et al. | |
| 5,645,079 | A | | 7/1997 | Zahiri et al. | |
| 5,661,859 | A | * | 9/1997 | Schaefer | 5/621 |
| 5,740,572 | A | | 4/1998 | Hannant | |
| 5,774,914 | A | | 7/1998 | Johnson et al. | |
| 5,802,641 | A | | 9/1998 | Van Steenburg | |
| 5,862,549 | A | | 1/1999 | Morton et al. | |
| 5,926,878 | A | | 7/1999 | Morton et al. | |
| 5,941,175 | A | | 8/1999 | Bannister | |
| 5,961,085 | A | | 10/1999 | Navarro et al. | |
| 6,058,534 | A | | 5/2000 | Navarro et al. | |

* cited by examiner

BIRTHING BED FOOT SECTION ATTACHMENT MECHANISM

BACKGROUND AND SUMMARY OF THE INVENTION

This invention relates to a birthing bed. and particularly to a removable foot section for a birthing bed. More particularly, this invention relates to an apparatus for attaching a removable foot section to a birthing bed.

Conventional birthing beds typically have a detachable foot section. The removal of the foot section permits a caregiver to slide a footstool into the space vacated by the foot section so as to be in position to assist in delivery. After delivery, the foot section is reattached to a patient support deck (hereafter, "the patient support") of the birthing bed. The present invention comprises improvements to such beds.

The present invention will be described primarily as a birthing or delivery bed, but it will be understood that the same may be used in conjunction with any other patient support apparatus, such as a hospital stretcher or an operating table. Also, the present invention will be described primarily as a mechanism for attaching a removable foot section to the patient support such that the foot section extends generally horizontally in the plane of the patient support. But it will be understood that the same may be used for attaching a removable head section or a removable side panel to the patient support such that the removable head section or the removable side panel, as the case may be, extends generally horizontally in the plane of the patient support.

A foot section attachment mechanism in accordance with this invention comprises corresponding engagement members which prevent a removable foot section from being coplanar with the patient support until the foot section is completely inserted into the bed. In an illustrative embodiment, the engagement members comprise guides configured such that the foot section is not aligned with the patient support until the foot section is fully inserted.

According to another embodiment of the invention, the foot section must be inserted into the bed at an angle relative to the patient support, and is configured to become generally coplanar with the patient support only when it is fully inserted into the bed.

According to still another embodiment, if the foot section is inserted only a part of the way into the bed and let go, it will assume a non-coplanar position with respect to the patient support. The foot section will become generally coplanar with the patient support only when it is fully inserted into the bed.

According to a further embodiment of the present invention, a birthing bed includes a patient support coupled to a main frame. A removable foot section is configured for insertion into the patient support. A guide track that diverges toward the foot end thereof is coupled to the foot section for receiving a guide member coupled to the patient support when the foot section is inserted into the bed. As used in this description with reference to the bed, the phrase "foot end" will be used to denote the end of any referred-to object (for example, the guide track) that is positioned to lie nearest the foot end of the bed. The diverging guide track includes a ramp portion near the foot end, which is configured for engaging the guide member coupled to the patient support as the foot section is inserted into the bed to cause the foot section to align with the patient support. A latch coupled to the guide track latches the foot section to the patient support when the foot section is fully inserted into and aligned with the patient support.

Additional features of the present invention will become apparent to those skilled in the art upon a consideration of the following detailed description of the preferred embodiments exemplifying the best mode of carrying out the invention as presently perceived.

BRIEF DESCRIPTION OF THE DRAWINGS

The detailed description particularly refers to the accompanying figures in which.

DETAILED DESCRIPTION OF THE DRAWINGS

The present invention will be described primarily as a birthing or delivery bed, but it will be understood that the same may be used in conjunction with any other patient support apparatus, such as a hospital stretcher or an operating table. Also, the present invention will be described primarily as a mechanism for attaching a removable foot section to the patient support such that the foot section extends generally horizontally in the plane of the patient support. But it will be understood that the same may be used for attaching a removable head section or a removable side panel to the patient support such that the head section or the side panel, as the case may be, extends generally horizontally in the plane of the patient support.

Figure 1:
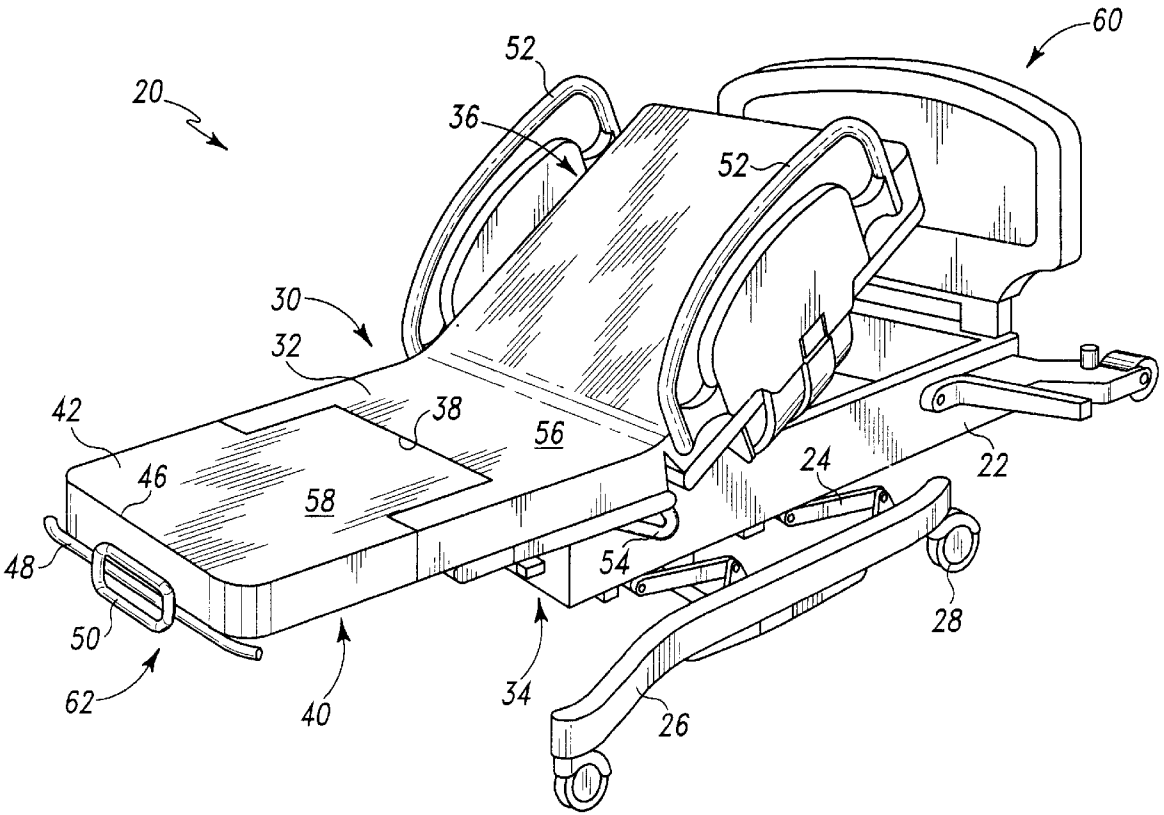
FIG. 1 is a perspective view of a birthing bed showing a removable foot section filly inserted into the bed and latched to the patient support, the foot section extending generally horizontally in the plane of the patient support, and further showing a head section raised to a reclining position.
Figure 2:
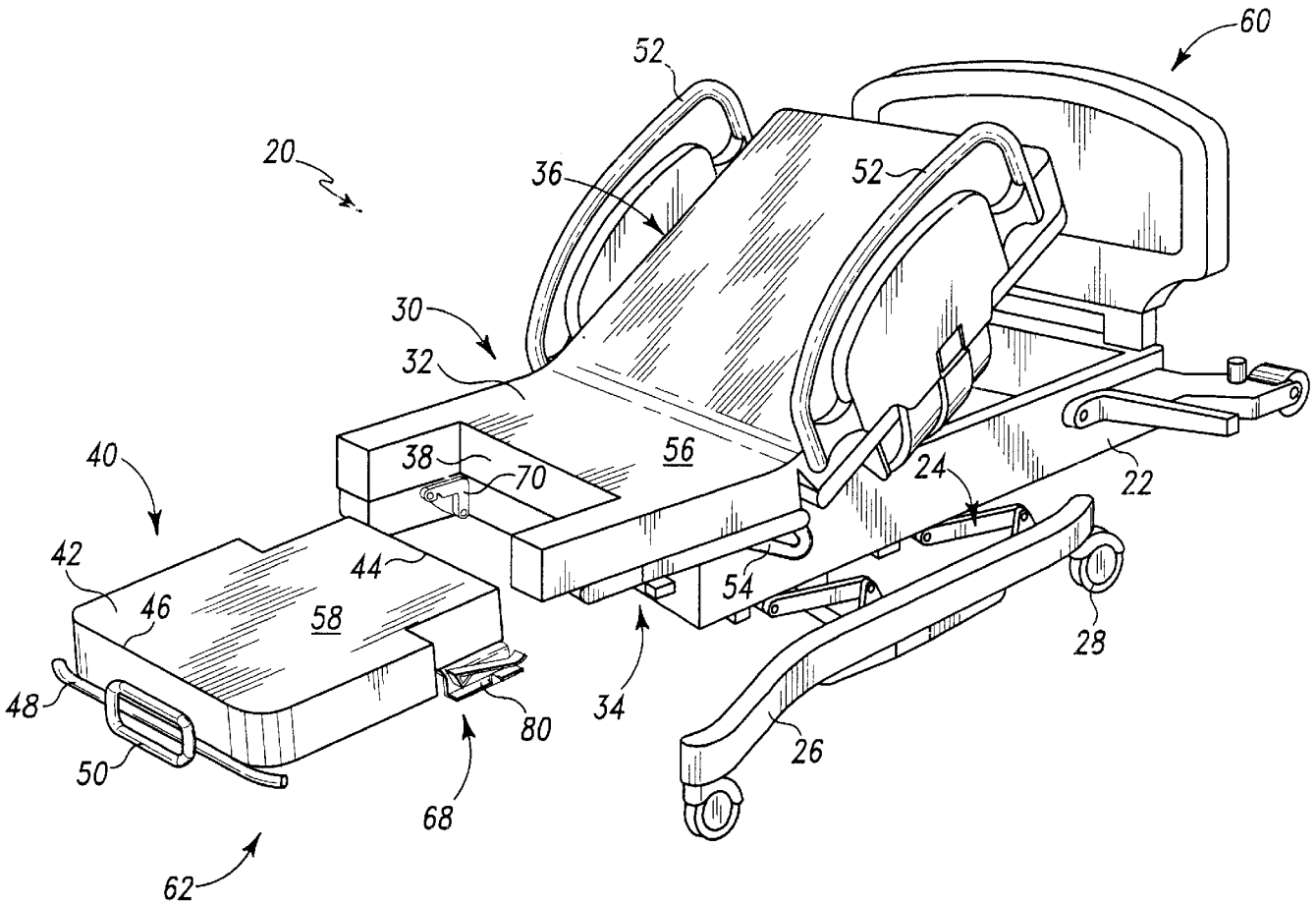
FIG. 2 is a perspective view of a birthing bed similar to FIG. 1, but showing the foot section detached from the seat section.
Figure 3:
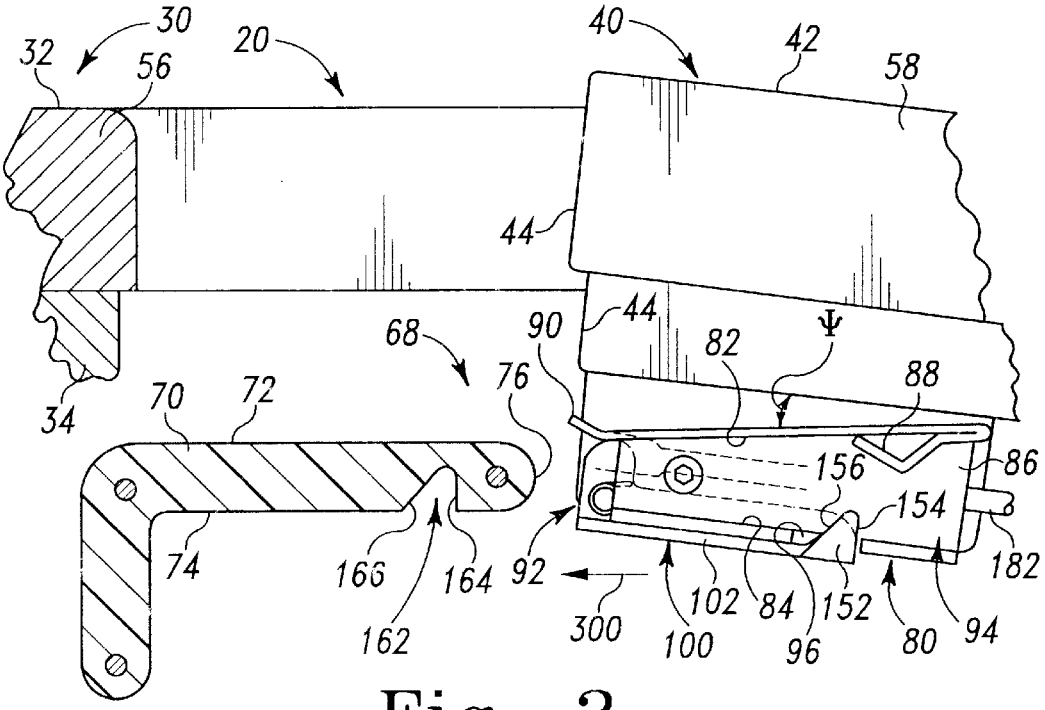
FIG. 3 is a side elevation view, partly in section, of a portion of the birthing bed showing a foot section attachment mechanism in accordance with an embodiment of this invention, the foot section attachment mechanism including a guide member coupled to the main frame and configured for extending into a diverging guide channel coupled to the foot section when the foot section is inserted into the birthing bed the diverging guide channel including a ramp portion near the foot end thereof which is configured to engage the guide member when the foot section is inserted into the birthing bed to cause the foot section to align with the patient support, a latch bar pivotally coupled to the foot section is configured to lock the foot section to the patient support when the foot section is fully inserted into the birthing bed and the foot section is aligned with the patient support.
Figure 4:
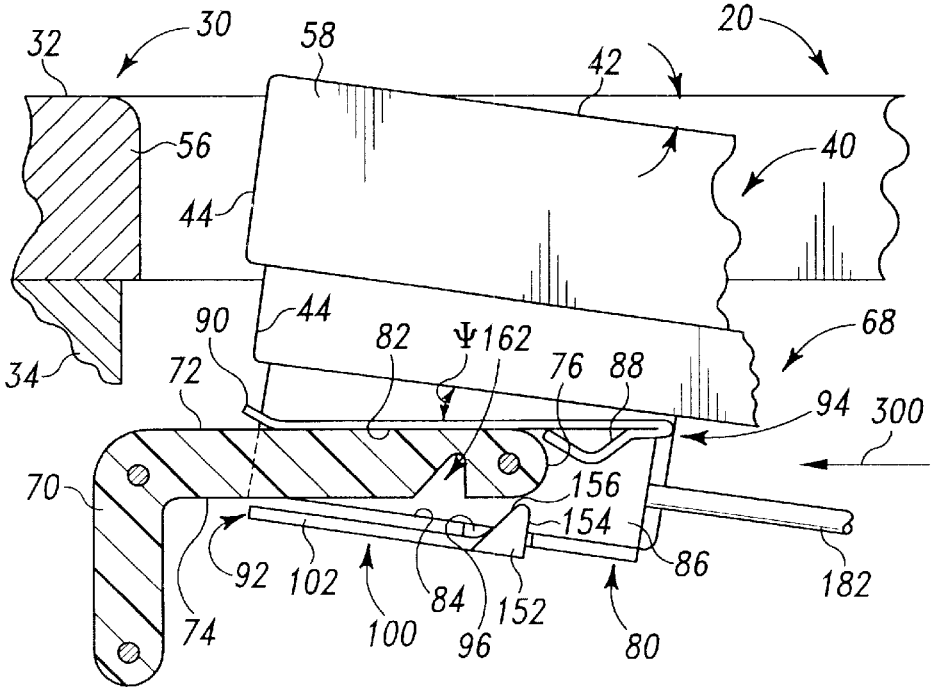
FIGS. 4–6 are side elevation views, partly in section, similar to FIG. 3, and showing a sequence of steps involved in attaching the foot section to the patient support.
Figure 5:
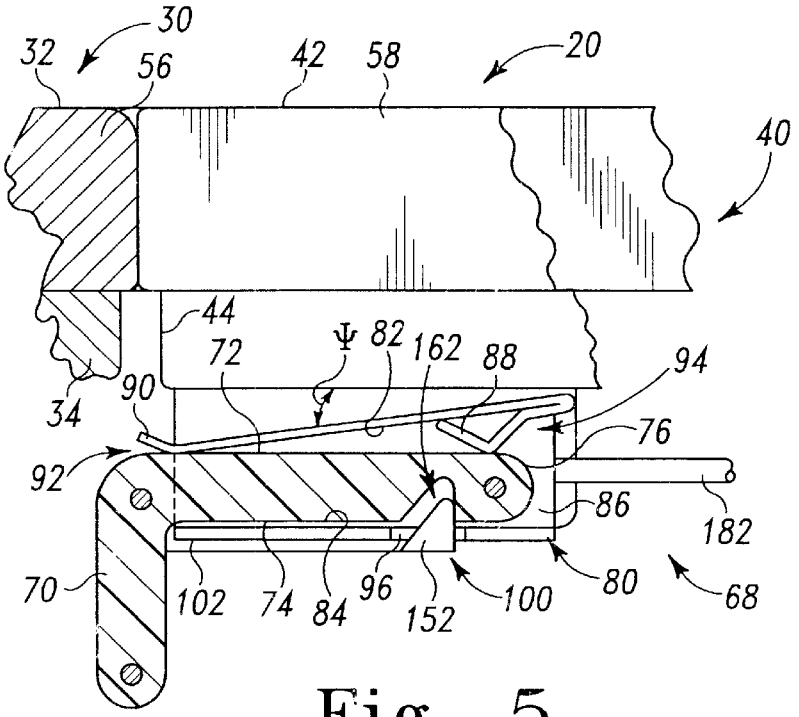

Referring to FIGS. 1 and 2, an illustrative birthing bed 20 is shown having a main frame 22 mounted by a parallelogram linkage 24 to a base frame 26. The base frame 26 has casters 28 for supporting the bed 20 on the floor. The bed 20 includes a patient support deck 30 (hereafter, "the patient support 30") for supporting a mattress 56 on which a patient can rest. The patient support 30 includes a generally horizontal seat section 34 rigidly mounted to the main frame 22. A head section 36 is pivotally mounted to the seat section 34 so that the bed 20 can be articulated between a generally horizontal lying-down position defining a generally horizontal, upwardly-facing surface 32 in the plane of the seat section 34, a generally reclining sitting-up position inclined with respect to the seat section 34, and an infinite number of intermediate positions in between. The seat section 34 includes a central opening 38 into which a removable foot section 40 is inserted such that an upper surface 42 of the foot section 40 extends generally horizontally in the plane of the patient support surface 32 when the foot section 40 is fully inserted into the central opening 38 and latched to the seat section 34. A detachable portion 58 of the mattress 56 is secured to the foot section 40 by any suitable means—such as a plurality of Velcro pads. (Velcro is a registered trademark.)

Figure 8:
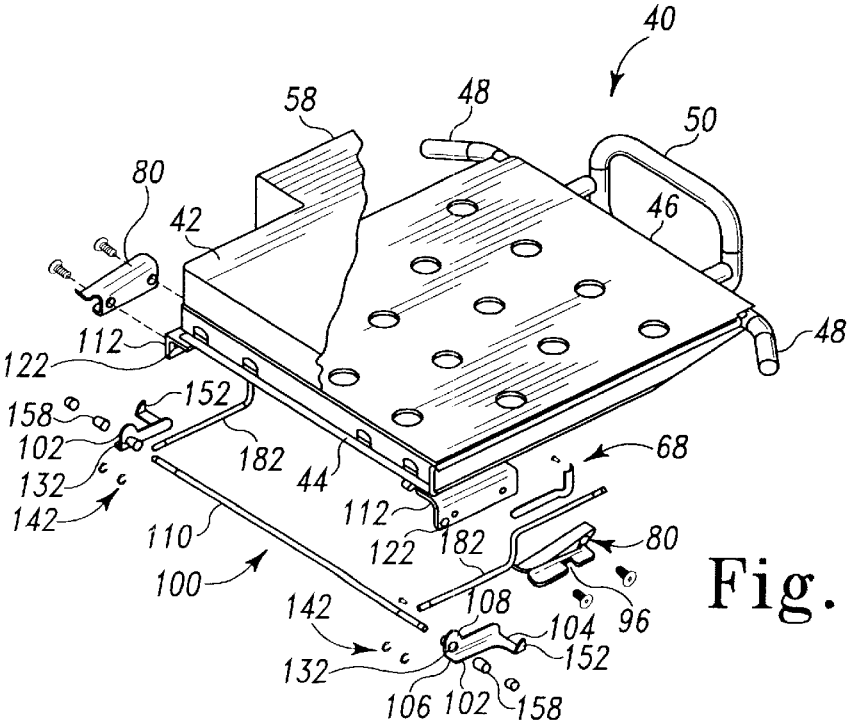
FIG. 8 is an exploded view of the foot section and the foot section locking mechanism.

As shown in FIG. 8, the foot section 40 includes a pair of handles 48, one on each side, adjacent to a foot end 46 of the foot section 40. The handles 48 assist the caregiver to pull the foot section 40 away from the bed 20 so that the foot section 40 can be detached from the patient support 30 and stored. The foot section 40 includes a floor stand 50 adjacent to the foot end 46 for vertically supporting the foot section 40 on the floor. As used in this description with reference to the bed 20, the phrase "head end" will be used to denote the end of any referred-to object that is positioned to lie nearest the head end 60 of the bed 20, and the phrase "foot end" will be used to denote the end of any referred-to object that is positioned to lie nearest the foot end 62 of the bed 20.

The head section 36 has two side guards 52 mounted thereon, one on each side of the head section 36, to prevent a patient from inadvertently rolling off the bed 20. Mounted to the underside of the seat section 34 are labor grips 54, one on each side of the bed 20. The labor grips 54 have two principal positions—a vertical operative position projecting substantially perpendicularly to the seat section 34, and a horizontal out-of-the-way storage position tucked underneath the seat section 34. In their vertical operative positions, the labor grips 54 can be gripped by the mother to assist her in generating maximum thrust during delivery.

FIGS. 3–6 illustrate a foot section attachment mechanism 68 in accordance with an embodiment of the present invention. The foot section attachment mechanism 68 includes two guide members 70 coupled to the main frame 22, one on each side of the bed 20, and two guide tracks 80 coupled to the foot section 40, one on each side of the foot section 40. Although the guide members 70 are coupled to the main frame 22 in this particular embodiment, they may very well be coupled instead to the seat section 34 which is rigidly mounted to the main frame 22. Since the construction and the operation of the two guide members 70 and the two guide tracks 80 is similar, only one guide member and one guide track will be described herein in the interest of brevity. It will be understood that the construction and the operation of the other guide member and the other guide track is similar. The two guide members 70 and the two guide tracks 80 are sometimes referred to herein as the cooperating engagement members.

The guide track 80 includes a lip portion 90 near its entrance 92. The lip portion 90 engages a leading edge 76 of the guide member 70 during insertion of tile loot section 40 into the bed 20 to direct the guide member 70 into the guide track 80. The guide member 70 includes a first upwardly-facing surface portion 72 on an upper side thereof and a second downwardly-facing, surface portion 74 on an underside thereof, both surface portions 72 and 74 extending generally parallel to the generally horizontal, upwardly-facing surface 32 of the seat section 34. The guide track 80 coupled to the foot section 40 includes a first downwardly-facing surface portion 82 on an upper side thereof extending generally at an angle $\psi$ with respect to the upwardly-facing surface 42 of the foot section 40 (illustratively, between 10° and 30°), and a second upwardly facing surface portion 84 on a lower side thereof extending generally parallel to the upwardly-facing surface 42 of the loot section 40. The first downwardly-facing surface portion 82 and the second upwardly-facing surface portion 84 of the guide track 80 form a diverging guide channel 86 into which the guide member 70 extends when the foot section 40 is inserted into the bed 20 in the direction of arrow 300. The first generally-inclined, downwardly-facing surface portion 82 of the guide track 80 includes a downwardly-projecting ramp portion 88 near its foot end 94 (sometimes referred to herein as "the inner end"), which engages the leading edge 76 of the guide member 70 when the foot section 40 is inserted into the bed 20 (a) to cause the first generally-inclined, downwardly-facing surface portion 82 of the guide track 80 to move away from the first generally-horizontal, upwardly-facing surface portion 72 of the guide member 70, and (b) to cause the second generally-parallel, upwardly-facing surface portion 84 of the guide track 80 to move closer to the second generally-horizontal, downwardly-facing surface portion 74 of the guide member 70 to, in turn, cause the upwardly-facing surface 42 of the foot section 40 to align with the upwardly-facing surface 32 of the patient support 30.

Figure 7:
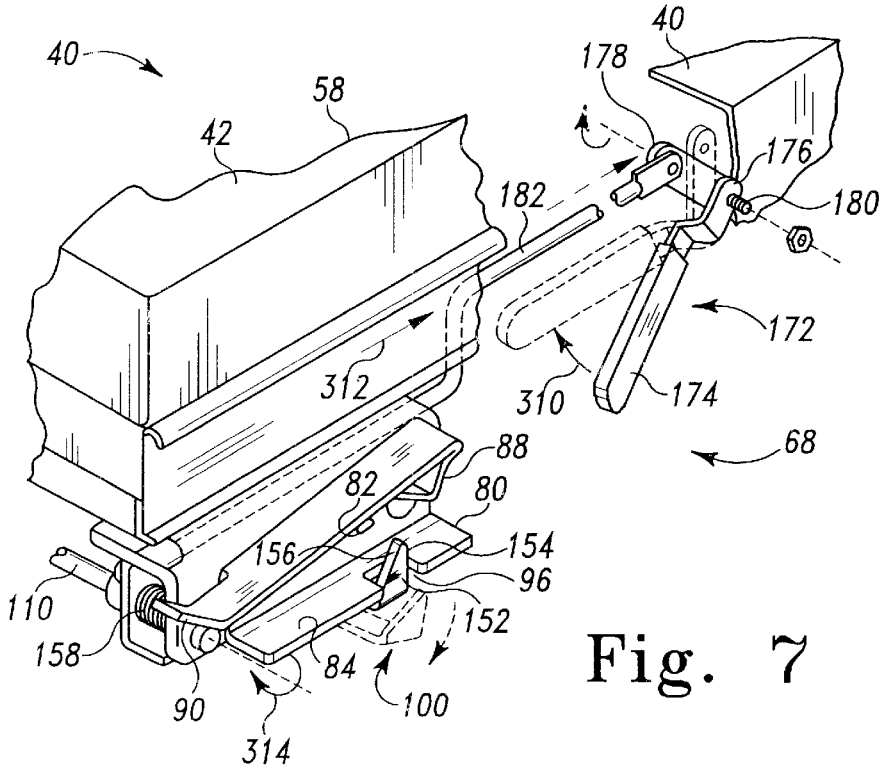
FIG. 7 is a perspective view of the foot section, partly broken away, showing a release handle coupled to the latch bar for releasing the foot section from the patient support.

The foot section 40 includes a foot section locking mechanism 100 shown in FIGS. 7 and 8. The foot section locking mechanism 100 locks the foot section 40 to the patient support 30 when the foot section 40 is fully inserted into the bed 20 and the upwardly-facing surface 42 of the foot section 40 is aligned with the upwardly-facing surface 32 of the patient support 30. The foot section locking mechanism 100 includes two latch bars 102 pivotally mounted on opposite sides of the foot section 40 by means of a transversely-extending connecting rod 110. Attached to the underside of the foot section 40 near the head end 44 thereof are two downwardly-projecting brackets 112, one on each side of the foot section 40. As shown in FIG. 8, the two ends of the connecting rod 110 are passed through two slightly oversized openings 122 in the downwardly projecting brackets 112 and through two slightly oversized openings 132 in the two latch bars 102, and securely held in place by two sets of C-shaped retaining rings 142—one on each side of the foot section 40.

Since the two latch bars 102 are mirror images of each other, only one latch bar will be described herein in the interest of brevity. It will be understood that the construction and operation of the other latch bar is similar. The latch bar 102 is movable between (a) a first operative position where a generally triangular portion 152 coupled to a first end 104 of the latch bar 102 enters a generally triangular retaining slot 162 in the guide member 70 through an opening 96 in the second upwardly-facing surface portion 84 of the guide track 80 to lock the foot section 40 to the patient support 30 when the foot section 40 is fully inserted into the bed 20 and the upwardly-facing surface 42 of the foot section 40 is aligned with the upwardly-facing surface 32 of the patient support 30, and (b) a second inoperative position where the triangular portion 152 is out of the retaining slot 162 to release the foot section 40. A spring 158 coupled to the latch bar 102 biases the latch bar 102 toward its first operative position Illustratively, in this embodiment, the triangular portion 152 coupled to the first end 104 of the latch bar 102 is formed integrally therewith.

The triangular portion 152 includes a first generally vertical side 154 adapted for engaging a first generally vertical side 164 of the retaining slot 162, and a second generally inclined side 156 adapted for engaging a second generally inclined side 166 of the retaining slot 162. During, attachment of the foot section 40 to the rest of the bed 20, the inclined side 156 of the latch bar 102 cams against the leading edge 76 of the guide member 70 thereby pivoting the latch bar 102 downwardly against the bias of the spring 158 until the triangular portion 152 of the latch bar 102 aligns with the retaining slot 162 in the guide member 70 at which point the spring 158 biases the latch bar 102 upwardly so that the triangular portion 152 is received in the retaining slot 162. Thus, the spring 158 coupled to the latch bar 102 inserts the triangular portion 152 into the retaining slot 162 in the guide member 70 to lock the foot section 40 to the patient support 30 when the foot section 40 is fully inserted into the bed 20 and the upwardly-facing, surface 42 of the foot section 40 is aligned with the upwardly-facing, surface 32 of the patient support 30. The first vertical side 154 of the triangular portion 162 of the latch bar 102 bears against the first vertical side 164 of the retaining slot 162 in the guide member 70 to prevent extraction of the foot section 40 from the bed 20.

Figure 6:
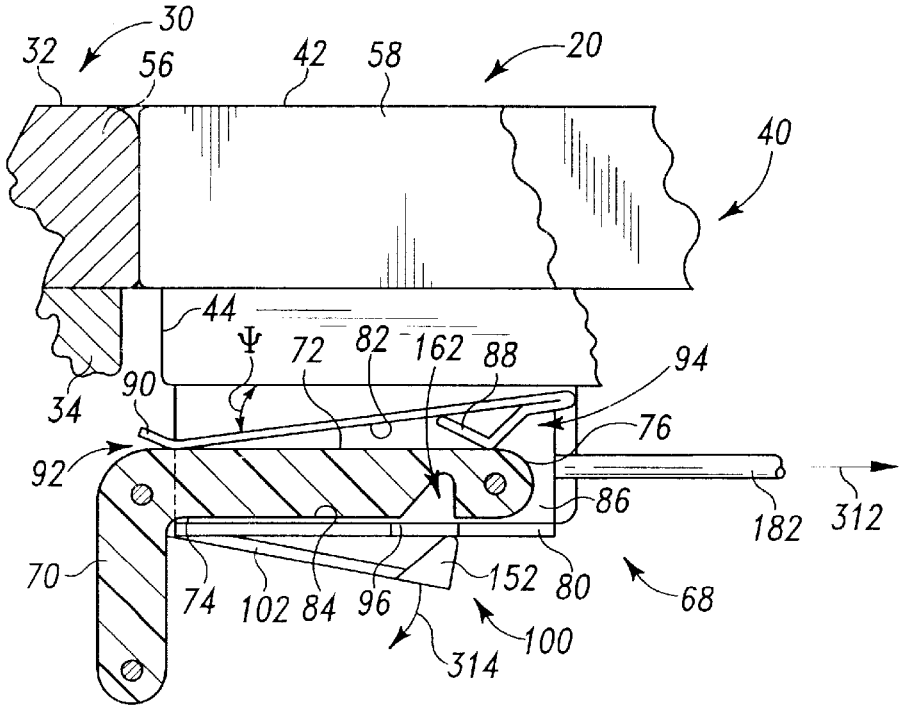

As indicated before, the foot section 40 can be detached from the patient support 30 and stored. The extraction of the foot section 40 permits a caregiver to slide a footstool into the space vacated by the foot section 40 to be in position to assist in delivery. To this end, a foot section release handle 172 is mounted to the foot section 40 adjacent to its foot end 46 as shown in FIGS. 7 and 8. The foot section release handle 172 includes a first portion 174 providing a handle, a middle portion 176 pivotally coupled to the foot section 40 about a transversely-extending pivot pin 180, and a third portion 178 pivotally coupled to a third portion 108 of the latch bar 102 by a longitudinally-extending, coupling rod 182. When the release handle 172 is rotated clockwise in the direction of arrow 310, the coupling rod 182 moves outwardly in the direction of arrow 312. As shown in FIGS. 6 and 7, the outward motion of the coupling rod 182, in turn, causes the latch bar 102 to turn clockwise in the direction of arrow 314, whereby the triangular portion 152 coupled to latch bar 102 disengages from the retaining slot 62 to free the foot section 40.

Thus, the foot section attachment mechanism 68 is configured such that the upper surface 42 of the foot section 40 will not become parallel with the upper surface 32 of the seat section 34 until the foot section 40 is fully inserted into the opening 38 in the seat section 34. Upon full insertion of the foot section 40 into the opening 38, the locking mechanism 100 automatically locks the foot section 40 to the rest of the bed 20. Therefore, the foot section attachment mechanism 68 enhances the safety of the bed 20 because the caregiver is provided with a visual indication (i.e., the orientation of the upper surface 42 of the foot section 40) regarding whether the foot section 40 is properly attached to the rest of the bed 20.

Figure 9:
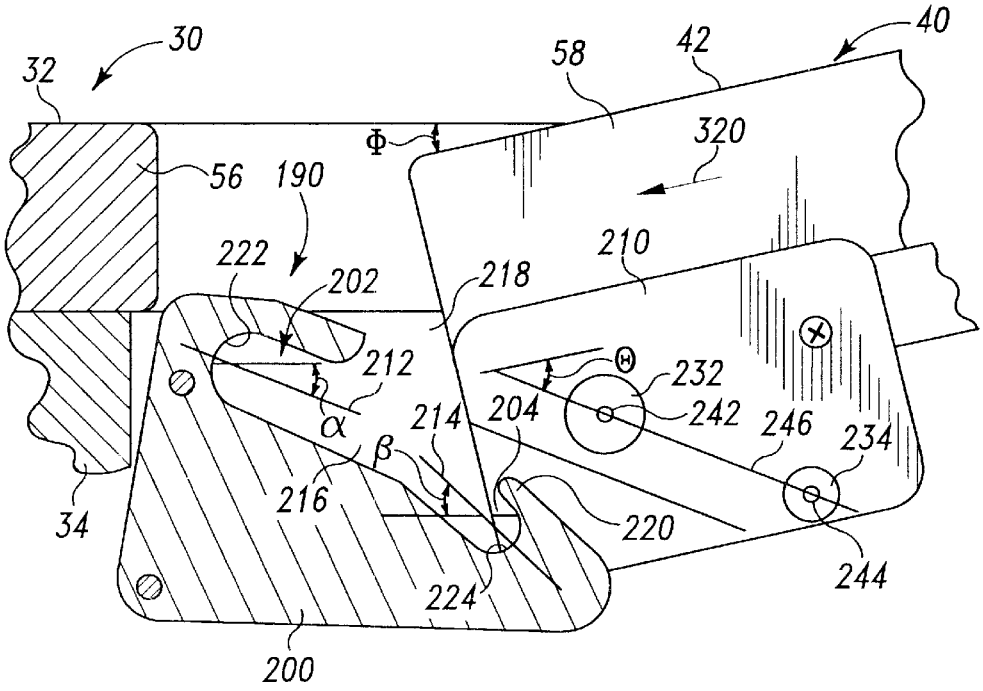
FIGS. 9 and 10 are side elevation views, partly in section, of an alternative embodiment of the present invention comprising two posts attached to the foot section configured for insertion into two oppositely-disposed retaining slots in the patient support to lock the foot section to the patient support, the foot section not aligning with the patient support until the foot section is completely inserted and locked to the patient support.
Figure 10:
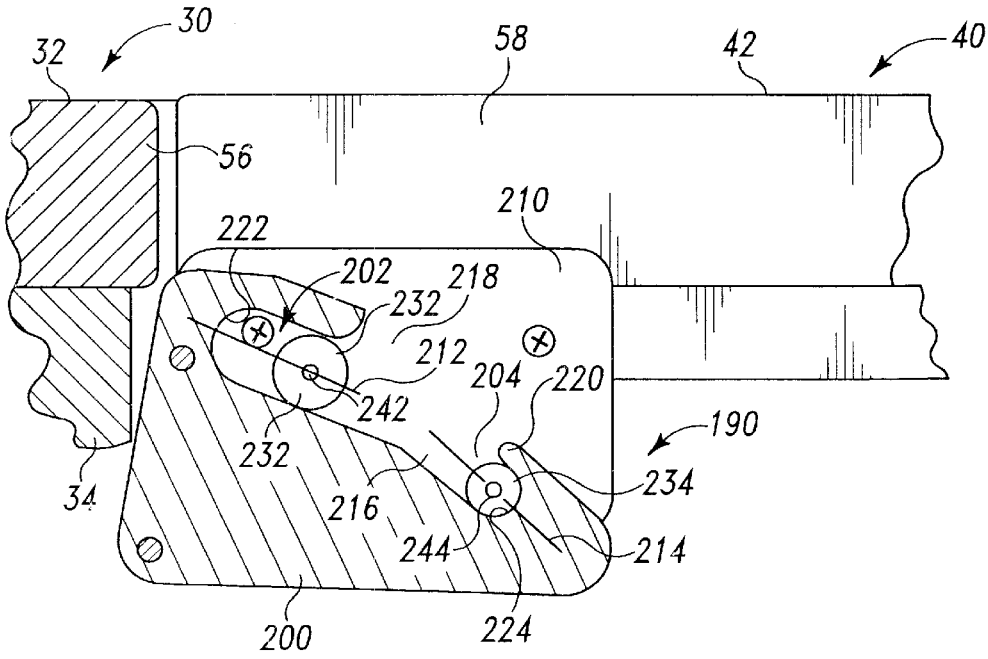

An alternative embodiment of the present invention is shown in FIGS. 9 and 10. As shown therein, a foot section attachment mechanism 190 includes two guide members 200 coupled to the main frame 22, one on each side of the bed 20, and two brackets 210 coupled to the removable foot section 40, one on each side of the foot section 40. Although the guide members 200 are coupled to the main frame 22 in this particular embodiment, they may very well be coupled instead to the seat section 34 which is rigidly mounted to the main frame 22. Since the construction and the operation of the two guide members 200 and the two brackets 210 is similar, only one guide member and one bracket will be described herein. It will be understood that the construction and the operation of the other guide member and the other bracket is similar. The two guide members 200 and the two brackets 210 are sometimes referred to herein as the cooperating engagement members.

The guide member 200 coupled to the main frame 22 includes two oppositely-disposed retaining slots—a leading forwardly-extending, retaining slot 202 extending downwardly toward the foot end 62 of the bed 20, and a trailing rearwardly-extending retaining slot 204 extending upwardly toward the head end 60 of the bed 20. The bracket 210 coupled to the foot section 40, on the other hand, includes two posts—a leading post 232 near the head end 44 of the foot section 40 and a trailing post 234 near the foot end 46 of the foot section 40. The two retaining slots 202 and 204 form a passageway 216 in the guide member 200 that terminates into an opening 218 through which the two posts 222 and 224 enter the two retaining slots 202 and 204 respectively when the foot section 40 is inserted into the bed 20 to lock the foot section 40 to the patient support 30.

As shown in FIGS. 9 and 10, the leading forwardly-extending retaining slot 202 extending downwardly toward the foot end 62 of tile bed 20 has a central axis 212 that subtends a first angle $\alpha$ a relative to the upwardly-facing surface 32 of the patient support 30. On the other hand, the trailing rearwardly-extending retaining slot 204 extending upwardly toward the head end 60 of the bed 20 has a central axis 214 that subtends a second angle $\beta$ relative to the upwardly-facing surface 32 of the patient support 30 that is larger than the first angle $\alpha$. Illustratively, the first angle $\alpha$ is about 30°. and the second angle $\beta$ is about 450 The two posts 232 and 234 are mounted to the bracket 210 by respective transversely-extending bolts 242 and 244. The two bolts 242 and 244 lie in a plane 246 that forms a third angle $\theta$ relative to the upwardly-facing surface 42 of the foot section 40 that lies between the first angle $\alpha$ and the second angle $\beta$. Illustratively, the third angle $\theta$ between the plane 246 and the upwardly-facing surface 42 of the foot section 40 is about 37.5° In the embodiment shown, the leading post 232 is made larger than the trailing post 234, and likewise the leading retaining slot 202 is made larger than the trailing retaining slot 204. This arrangement of unequal posts 232 and 234 and unequal retaining slots 202 and 204 prevents the larger leading post 232 from inadvertently entering the smaller trailing retaining slot 204 during insertion and removal of the foot section 40 into and from the rest of the bed 20.

In operation, as shown in FIG. 9, the foot section 40 is inserted into the bed 20 in the direction of arrow 320 at an angle $\phi$, about 30°, to insert the larger leading post 232 into the larger, forwardly-extending retaining slot 202 through the opening 218 in the guide member 200 during, forward motion of the foot section 40 toward the head end 60 of the bed 20. After the foot section 40 is fully inserted into the bed 20 so that the larger leading post 232 engages the bottom portion 222 of the forwardly-extending, retaining slot 202, it is pivoted downwardly about the larger leading post 232 This downward pivoting of the foot section 40 about the larger leading post 222 allows the smaller trailing post 234 to enter the smaller, rearwardly-extending, retaining slot 204 through the opening 218 in the guide member 200. When the foot section 40 is let go thereafter, it moves slightly outwardly toward the foot end 62 as shown in FIG. 10 until the smaller trailing post 234 engages the bottom portion 224 of the rearwardly-extending retaining slot 204. This outward motion of the foot section 40 allows the upwardly-facing surface 42 of the foot section 40 to align with the upwardly-facing surface 32 of the patient support 30, and simultaneously locks the foot section 40 to the patient support 30.

On the other hand, when the foot section 40 is inserted horizontally into the bed 20 in the plane of the upwardly-facing surface 32 of the patient support 30. a portion 220 of the guide member 200 near the opening 218 blocks the entry of the trailing post 234 into the passageway 216 in the guide member 200. Thus, the lip portion 220 of the guide member 200 prevents a partial entry of the foot section 40 into the bed 20. The foot section 40 must be inserted into the bed 20 at a certain angle $\phi$ relative to the upwardly-facing surface 32 of the patient support 30, and will become horizontal only when the foot section 40 is fully inserted into the bed 20 and locked in place.

In the particular embodiment described herein, the leading and trailing retaining slots 202 and 204 are illustratively formed in the guide member 200 secured to the main frame 22. However, the retaining slots 202 and 204 may very well be formed directly in the main frame 22 instead. Although two posts 232 and 234 are secured to the bracket 210 by bolts 242 and 244, the two posts 232 and 234 may be replaced by two rollers and pivotally secured to the bracket 210 by pivot pins instead. Also, the posts 232 and 234 may be directly mounted to the foot section 40.

Figure 11:
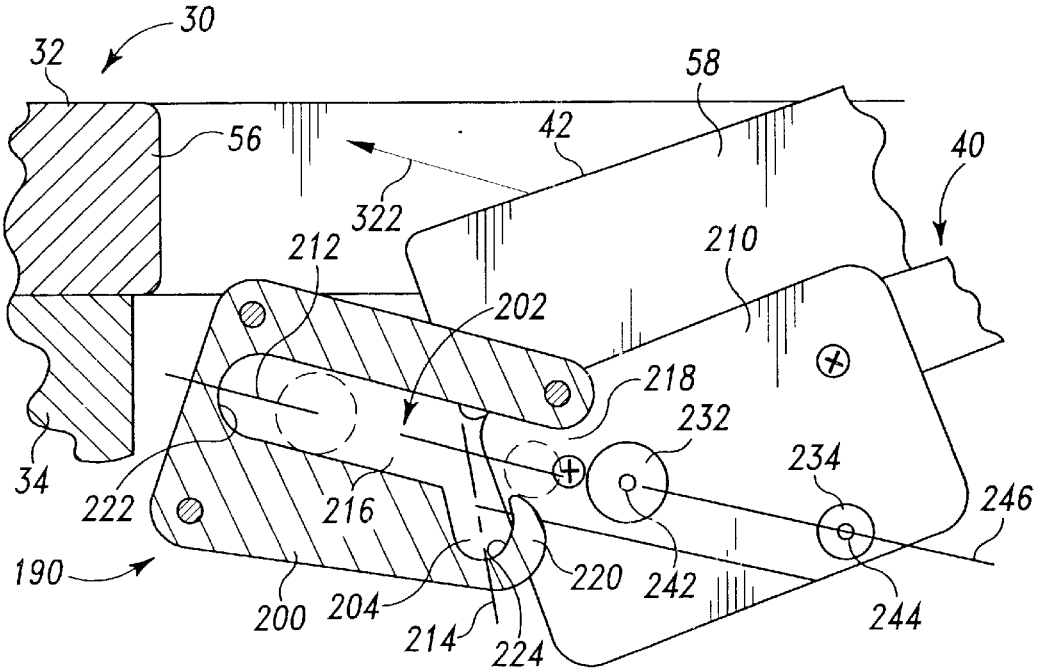
FIGS. 11 and 12 are side elevation views similar to FIGS. 9 and 10, partly in section, of a variation of the alternative embodiment shown in FIGS. 9 and 10.
Figure 12:
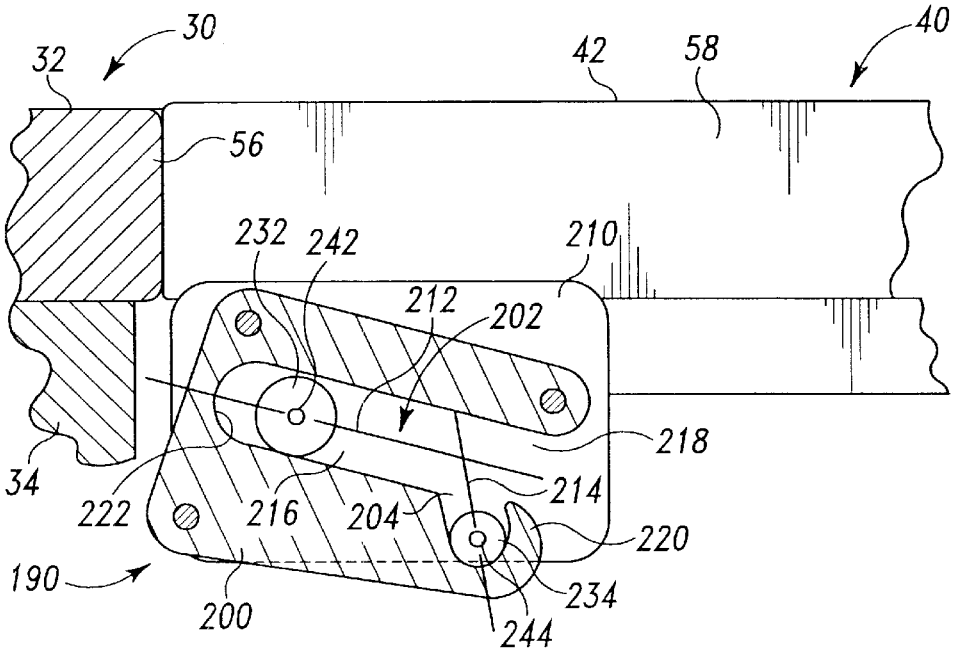

FIGS. 11 and 12 show a variation of the alternative embodiment of the foot section attachment mechanism 190 of FIGS. 9 and 10. The two posts 232 and 234 in the embodiment of FIGS. 11 and 12 are identical to those in the embodiment of FIGS. 9 and 10. The configuration of the retaining slots 202 and 204 is, however, slightly different. The operation of the embodiment of FIGS. 11 and 12 is, however, similar to the operation of the embodiment of FIGS. 9 and 10.

From the above disclosure of the general principles of the present invention and the preceding detailed description of the preferred embodiments, those skilled in the art will readily comprehend the various modifications to which the present invention is susceptible. We therefore desire to be limited only by the scope of the following claims and equivalents thereof

What is claimed is:

1. A patient support apparatus including a main frame, a patient support coupled to the main frame, a removable section configured for insertion into the patient support, an attachment mechanism for attaching the removable section to the patient support such that the removable section is not aligned with the patient support until the removable section is fully inserted into the patient support and latched thereto, and such that the removable section is aligned with the patient support only when the removable section is fully inserted into the patient support and latched to the patient support, the attachment mechanism comprising:

a guide member coupled to the main frame, the guide member including a first upwardly-facing surface portion on an upper side thereof and a second downwardly-facing surface portion on an underside thereof, both surface portions extending generally parallel to an upwardly-facing surface of the patient support, a guide track coupled to the removable section, the guide track including a first downwardly-facing surface portion on an upper side thereof extending generally at an angle with an upwardly-facing surface of the removable section and a second upwardly-facing surface portion on a lower side thereof extending generally parallel to the upwardly-facing surface of the removable section so as to form a diverging guide channel into which the guide member extends when the removable section is inserted into the patient support, the first generally-inclined, downwardly-facing surface portion of the guide track including a ramp portion near its diverging inner end adapted for engaging the guide member coupled to the main frame as the removable section inserted into the patient support (a) to cause the first generally-inclined, downwardly-facing surface portion of the guide track lo move away from the first generally-parallel, upwardly-facing surface portion of the guide member, and (b) to cause the second generally-parallel, upwardly-facing surface portion of the guide track to move closer to the second generally-parallel, downwardly-facing surface portion of the guide member to, in turn, cause the upwardly-facing surface of the removable section to align with the upwardly-facing surface of the patient support, and a removable section locking mechanism coupled to the removable section for latching the removable section to the patient support when the removable section is fully inserted into the patient support and the upwardly-facing surface of the removable section is aligned with the upwardly-facing surface of the patient support.

2. The attachment mechanism of claim 1, wherein the guide track includes a lip portion near the entrance of the guide track which is adapted for engagement with the guide member when the removable section is inserted into the patient support to direct the guide member into the guide track.

3. The attachment mechanism of claim 1, wherein the removable section is a removable foot section configured for attachment to a foot end of the patient support.

4. The attachment mechanism of claim 3, wherein the patient support is formed to include a central opening into which the foot section is inserted.

5. The attachment mechanism of claim 1, wherein the removable section locking mechanism comprises a latch bar movably coupled to the removable section for movement between (a) a first position where a protruding, portion coupled to a first end of the latch bar enters a retaining slot in the guide member to lock the removable section to the patient support when the removable section is fully inserted into the patient support and the upwardly-facing surface of the removable section is aligned with the upwardly-facing, surface of the patient support, and (b) a second position where the protruding portion is out of the retaining slot to free the removable section.

6. The attachment mechanism of claim 5, wherein a generally triangular portion coupled to a first end of the latch bar enters a generally triangular retaining slot in the underside of the guide member to lock the removable section to the patient support when the removable section is fully inserted into the patient support and the upwardly-facing, surface of the removable section is aligned with the upwardly-facing surface of the patient support, wherein the generally triangular portion includes a first generally vertical side near a foot end of the patient support adapted for engaging a first generally vertical side of the retaining slot and a second generally inclined side near a head end of the patient support adapted for engaging a second generally inclined side of the retaining slot, wherein a leading edge of the guide member is configured to engage the second generally inclined side of the generally triangular portion of the latch bar when the removable section is inserted into the patient support to push the latch bar out of the way, wherein the generally triangular portion coupled to the latch bar enters the retaining slot in the guide member to lock the removable section to the patient support when the removable section is fully inserted into the patient support and the upwardly-facing surface of the removable section is aligned with the upwardly-facing surface of the patient support, and wherein the first generally vertical side of the triangular portion of the latch bar bears against the first generally vertical side of the retaining slot in the guide member to prevent removal of the end section from the patient support.

7. The attachment mechanism of claim 6, wherein the latch bar has a second end pivotally coupled to the removable section about a first transverse axis for movement between the first and second positions, wherein the generally triangular portion coupled to the first end of the latch bar enters the generally triangular retaining slot in the underside of the guide member through an opening in the second generally-parallel, upwardly-facing surface portion of the guide track to lock the removable section to the patient support when the upwardly-facing surface of the removable section is aligned with the upwardly-facing surface of the patient support, and wherein the removable section locking mechanism includes a spring coupled to the latch bar for biasing the latch bar toward its first position.

8. The attachment mechanism of claim 7, wherein the removable section locking, mechanism includes an removable section release handle coupled to the latch bar such that the latch bar is moved to its second position freeing the removable section when the release handle is actuated.

9. The attachment mechanism of claim 8, wherein the release handle includes a first portion providing a handle, a middle portion that is pivotally coupled to the removable section about a second transverse axis, wherein the removable section locking mechanism includes a coupling rod having its ends pivotally coupled to a third portion of the release handle and a third end of the latch bar such that the latch bar is moved to its second position treeing the removable section when the release handle is actuated.

10. The attachment mechanism of claim 9, wherein the generally triangular portion coupled to the first end of the latch bar is integral therewith.

11. The attachment apparatus of claim 1, wherein the angle between the upwardly-facing surface of the removable section and the first generally-inclined, downwardly-facing surface portion of the guide track is between 10° and 30°.

12. In a birthing bed including a main frame, a patient support coupled to the main frame, the patient support including a generally-horizontal upwardly-facing surface, a removable foot section having an upwardly-facing surface configured for insertion into the patient support, a foot section attachment mechanism comprising:

a guide member coupled to the main frame, the guide member including a first upwardly-facing surface portion on an upper side thereof and a second downwardly-facing surface portion on an underside thereof both surface portions extending generally parallel to the generally-horizontal upwardly-facing surface of the patient support, a guide track coupled to the foot section, the guide track including a first downwardly-facing surface portion on an upper side thereof extending generally at an angle with the upwardly-facing surface of the foot section and a second upwardly-facing surface portion on a lower side thereof extending generally parallel to the upwardly-facing, surface of the foot section so as to form a diverging guide channel into which the guide member extends when the foot section is inserted into the patient support, the first generally-inclined, downwardly-facing surface portion of the guide track including a ram portion near its inner end adapted for engagement with the guide member coupled to the main frame when the foot section is inserted into the patient support (I) to cause the first generally-inclined, downwardly-facing surface portion of the guide track to move away from the first generally-horizontal, upwardly-facing surface portion of the guide member, and (ii) to cause the second generally-parallel, upwardly-facing surface portion of the guide track to move closer to the second generally-horizontal, downwardly-facing, surface portion of the guide member to, in turn, cause the upwardly-facing, surface of the foot section to align with the upwardly-facing surface of the patient support, and a foot section locking mechanism coupled to the foot section for latching the foot section to the patient support when the foot section is full inserted into the patient support and the upwardly-facing surface of the foot section is aligned with the upwardly-facing surface of the patient support.

* * * * *